US007832376B2

(12) United States Patent
Mueller et al.

(10) Patent No.: US 7,832,376 B2
(45) Date of Patent: Nov. 16, 2010

(54) DAMPING ELEMENT FOR A FUEL INJECTION VALVE

(75) Inventors: Martin Mueller, Moeglingen (DE); Michael Huebel, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 287 days.

(21) Appl. No.: 11/665,040

(22) PCT Filed: Sep. 8, 2005

(86) PCT No.: PCT/EP2005/054467

§ 371 (c)(1),
(2), (4) Date: Nov. 26, 2008

(87) PCT Pub. No.: WO2006/040227

PCT Pub. Date: Apr. 20, 2006

(65) Prior Publication Data

US 2009/0071445 A1 Mar. 19, 2009

(30) Foreign Application Priority Data

Oct. 9, 2004 (DE) ..... 10 2004 049 277

(51) Int. Cl.
*F02M 61/14* (2006.01)
*F02M 61/18* (2006.01)

(52) U.S. Cl. ..... 123/470

(58) Field of Classification Search ..... 123/470, 123/467, 456; 239/533.11, 600; 277/591, 277/594, 595, 596, 607
See application file for complete search history.

(56) References Cited

U.S. PATENT DOCUMENTS 3,841,277 A * 10/1974 Schafer ..... 123/470
4,201,172 A * 5/1980 Jaggle et al. ..... 123/470
4,428,593 A * 1/1984 Pearlstein ..... 277/596
4,647,012 A * 3/1987 Gartner ..... 251/148
5,129,658 A * 7/1992 Berton et al. ..... 277/591
5,630,400 A * 5/1997 Sumida et al. ..... 123/470
5,785,024 A * 7/1998 Takei et al. ..... 123/470

(Continued)

FOREIGN PATENT DOCUMENTS

DE 100 27 669 12/2001

(Continued)

OTHER PUBLICATIONS

Patent Abstracts of Japan, vol. 1998, No. 1, Jan. 30, 1998.

(Continued)

*Primary Examiner*—Mahmoud Gimie
(74) *Attorney, Agent, or Firm*—Kenyon & Kenyon LLP

(57) ABSTRACT

Damping elements for a fuel injection valve insertable into a receiving conduit of a cylinder head of an internal combustion engine are disposed between a valve housing of the fuel injection valve and a wall of the receiving conduit of the cylinder head. These damping elements, inter alia, decrease acoustic transfer from the fuel injection valve to the cylinder head. It is disadvantageous that conventional damping elements require a great deal of axial installation space with respect to a valve axis and have comparatively high manufacturing costs. With the damping element according to example embodiments of the present invention, the installation space required is reduced. Provision is made, according to example embodiments of the present invention, for the damping element to be in plate-shaped fashion.

18 Claims, 4 Drawing Sheets

U.S. PATENT DOCUMENTS

| | | | | |
|---|---|---|---|---|
| 5,954,343 | A | 9/1999 | Sumida et al. | |
| 5,954,353 | A | 9/1999 | Kincaid et al. | |
| 6,343,795 | B1 * | 2/2002 | Zerfass et al. | 277/593 |
| 6,745,956 | B1 * | 6/2004 | Bantle et al. | 239/533.3 |
| 6,866,026 | B2 * | 3/2005 | Mickelson | 123/470 |
| 6,899,087 | B2 | 5/2005 | Norgauer | |
| 2003/0164158 | A1 | 9/2003 | Reiter | |
| 2004/0020470 | A1 | 2/2004 | Norgauer | |
| 2004/0040543 | A1 * | 3/2004 | Mickelson | 123/470 |
| 2004/0060544 | A1 | 4/2004 | Reiter et al. | |
| 2009/0050113 | A1 * | 2/2009 | Liskow | 123/470 |

FOREIGN PATENT DOCUMENTS

| | | |
|---|---|---|
| DE | 100 38 763 | 2/2002 |
| EP | 1 357 284 | 10/2003 |
| FR | 2 851 791 | 9/2004 |
| JP | 6-10794 | 1/1994 |
| JP | 9 112697 | 5/1997 |
| JP | 9-242647 | 9/1997 |

OTHER PUBLICATIONS

Patent Abstracts of Japan, vol. 18, No. 212 (M-1593), Apr. 15, 1994.
International Search Report, PCT International Patent Application No. PCT/EP2005/054467, dated Nov. 16, 2005.

* cited by examiner

DAMPING ELEMENT FOR A FUEL INJECTION VALVE

FIELD OF THE INVENTION

The present invention relates to a damping element for a fuel injection valve.

BACKGROUND INFORMATION

A damping element for a fuel injection valve insertable into a receiving conduit of a cylinder head of an internal combustion engine, which element is disposed between a valve housing of the fuel injection valve and a wall of the receiving conduit of the cylinder head, is described in German Published Patent Application No. 100 38 763. The damping element is made up of two rigid rings between which an elastic intermediate ring is disposed. The damping element, inter alia, decreases acoustic transfer from the fuel injection valve to the cylinder head. It is disadvantageous that the damping element requires a great deal of axial installation space with respect to a valve axis, and has comparatively high manufacturing costs.

SUMMARY

The damping element according to example embodiments of the present invention, in contrast, may provide that an improvement may be achieved in simple fashion in that with a damping effect that is as good as in the existing art, less axial installation space with respect to the valve axis is necessary, in that the damping element is arranged in plate-shaped fashion. Sufficient elasticity of the damping element is achieved because of the plate-shaped arrangement and the mounting of the fuel injection valve on a collar of the plate-shaped damping element.

The damping element may have a first portion for bracing against a shoulder of the receiving conduit in the cylinder head and a second portion, angled with respect to the first portion, for bracing of the fuel injection valve, since axial installation space is saved by the angling of the second portion and sufficient elasticity of the damping element is moreover achieved.

The first portion may extend from the second portion radially inward with respect to a valve axis, since in this fashion the shoulder of the receiving conduit against which the damping element abuts is easier to manufacture than in the case of a first portion that extends radially outward from the first portion.

The first portion may be arranged in substantially flat or convex fashion.

The second portion may be arranged in collar-shaped, substantially conical, and/or convex fashion. The necessary elasticity of the damping element is thereby achieved.

The damping element may have a passthrough opening that can be penetrated by the fuel injection valve. The passthrough opening may be arranged on the first portion.

The first portion and the second portion may have at least one support, for bracing against the cylinder head or for bracing of the fuel injection valve, that is arranged in planar fashion or as an elevation. The smaller the support surface of the damping element on the cylinder head, the better the solid-borne sound-damping effect.

Provision may be made for the damping element to have two cover panels and an elastic intermediate layer disposed between the cover panels. This damping element fabricated from composite material exhibits particularly good solid-borne sound damping, since mechanical vibration energy is converted into thermal energy by internal friction in the elastic intermediate layer.

DETAILED DESCRIPTION

Figure 1:
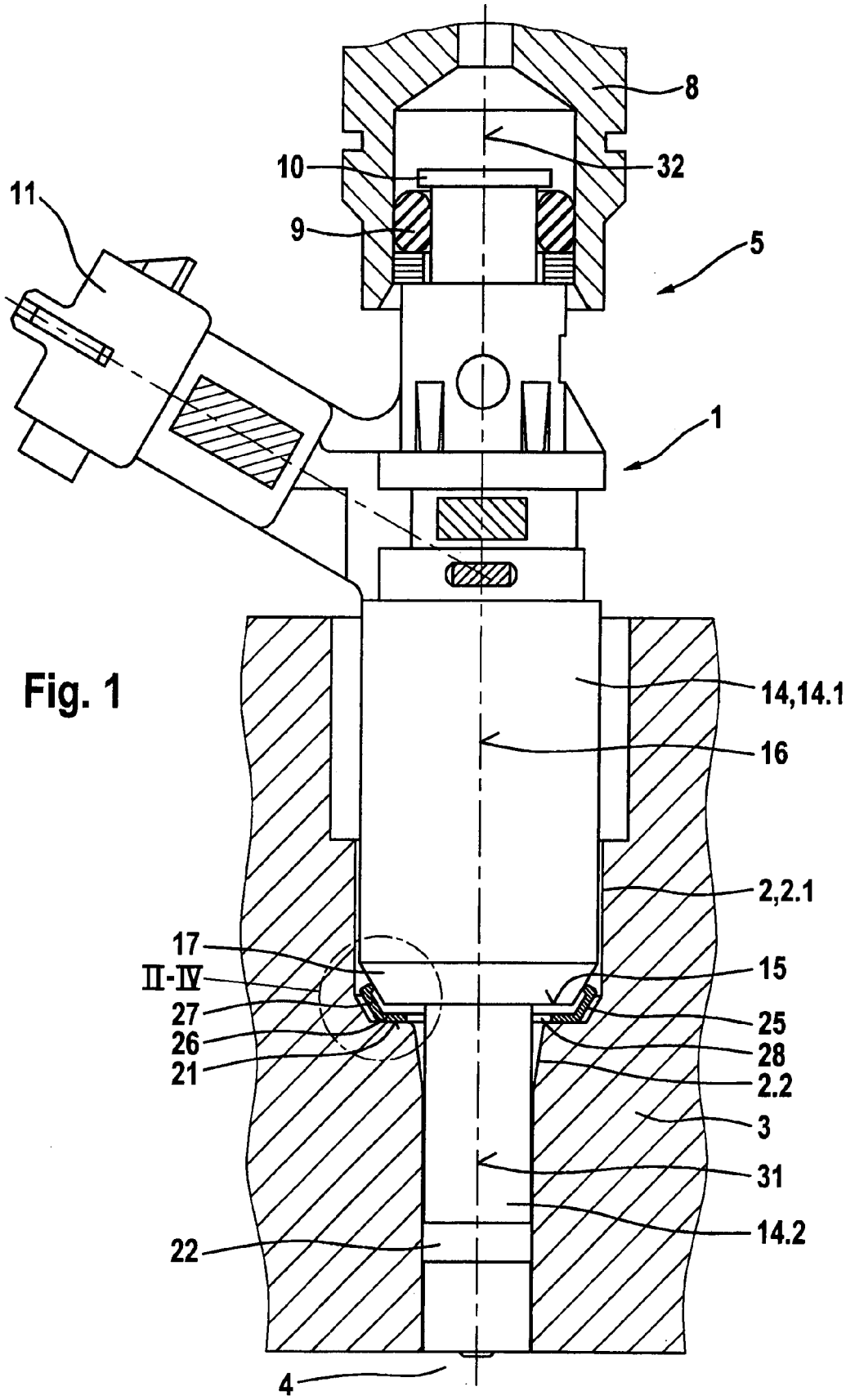
FIG. 1 is a cross-sectional of a fuel injection valve in a receiving bore of a cylinder head
Figure 2:
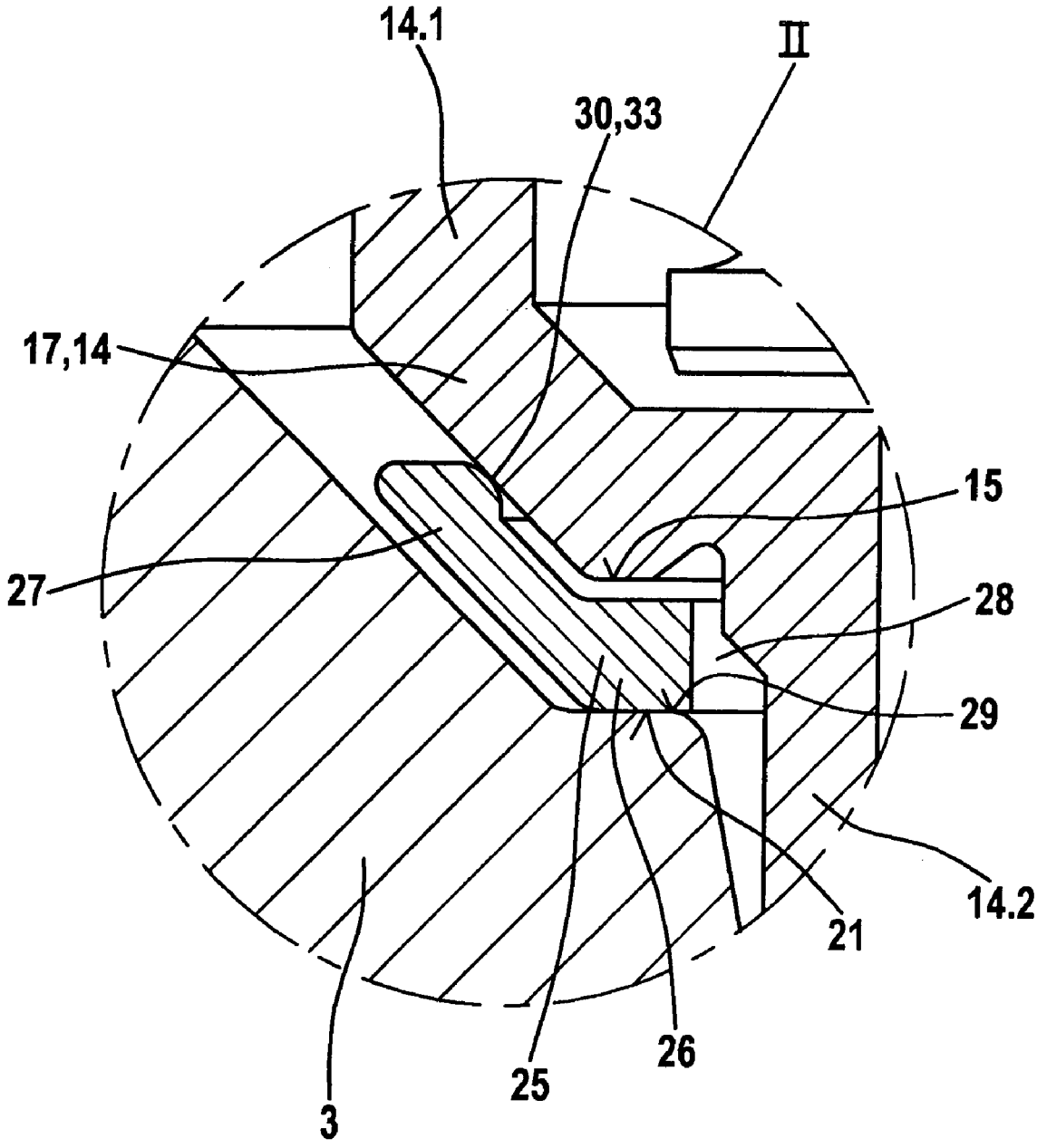
FIG. 2 illustrates aspects of an example embodiment of the present invention.
Figure 3:
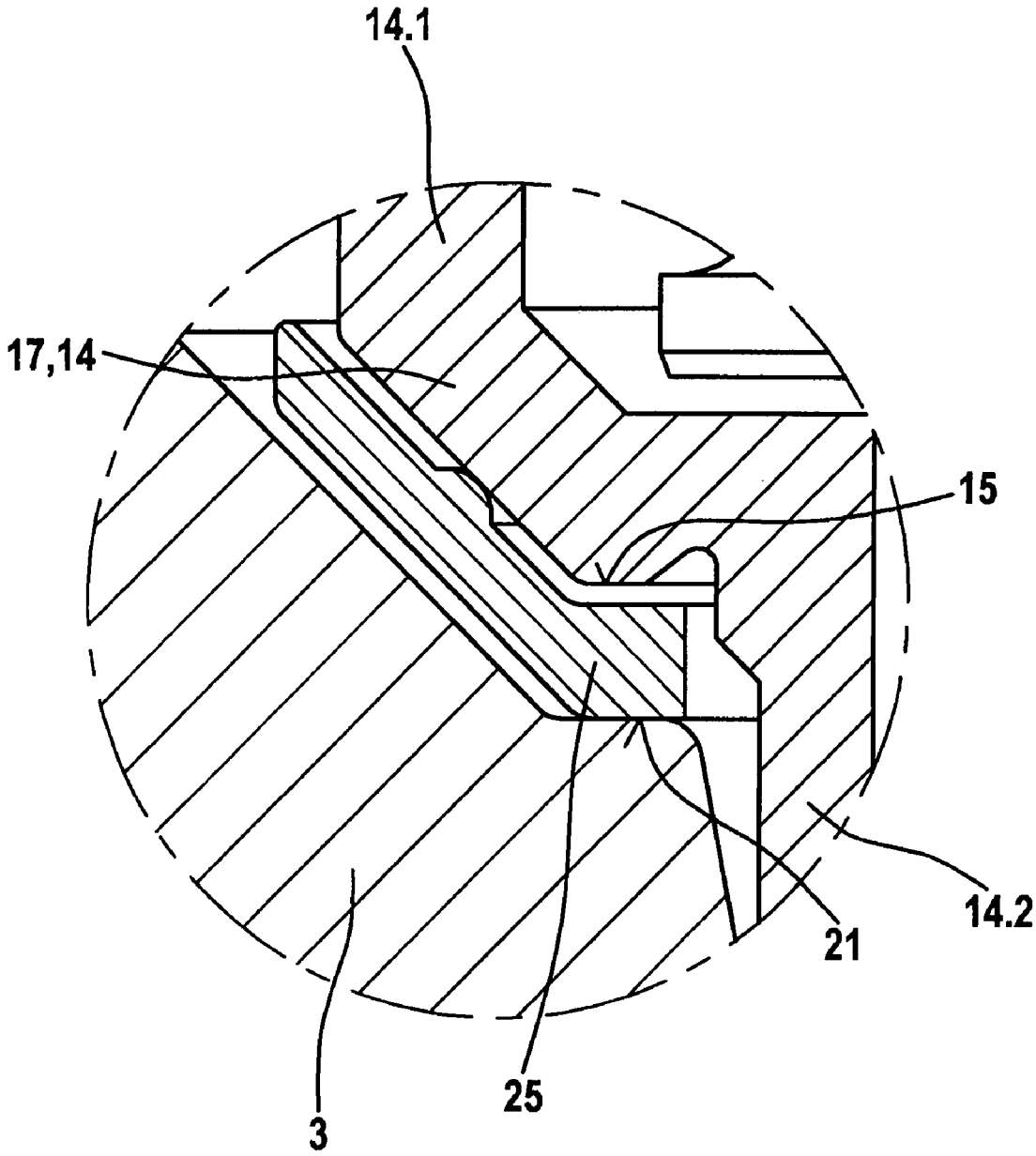
FIG. 3 illustrates aspects of an example embodiment of the present invention.
Figure 4:
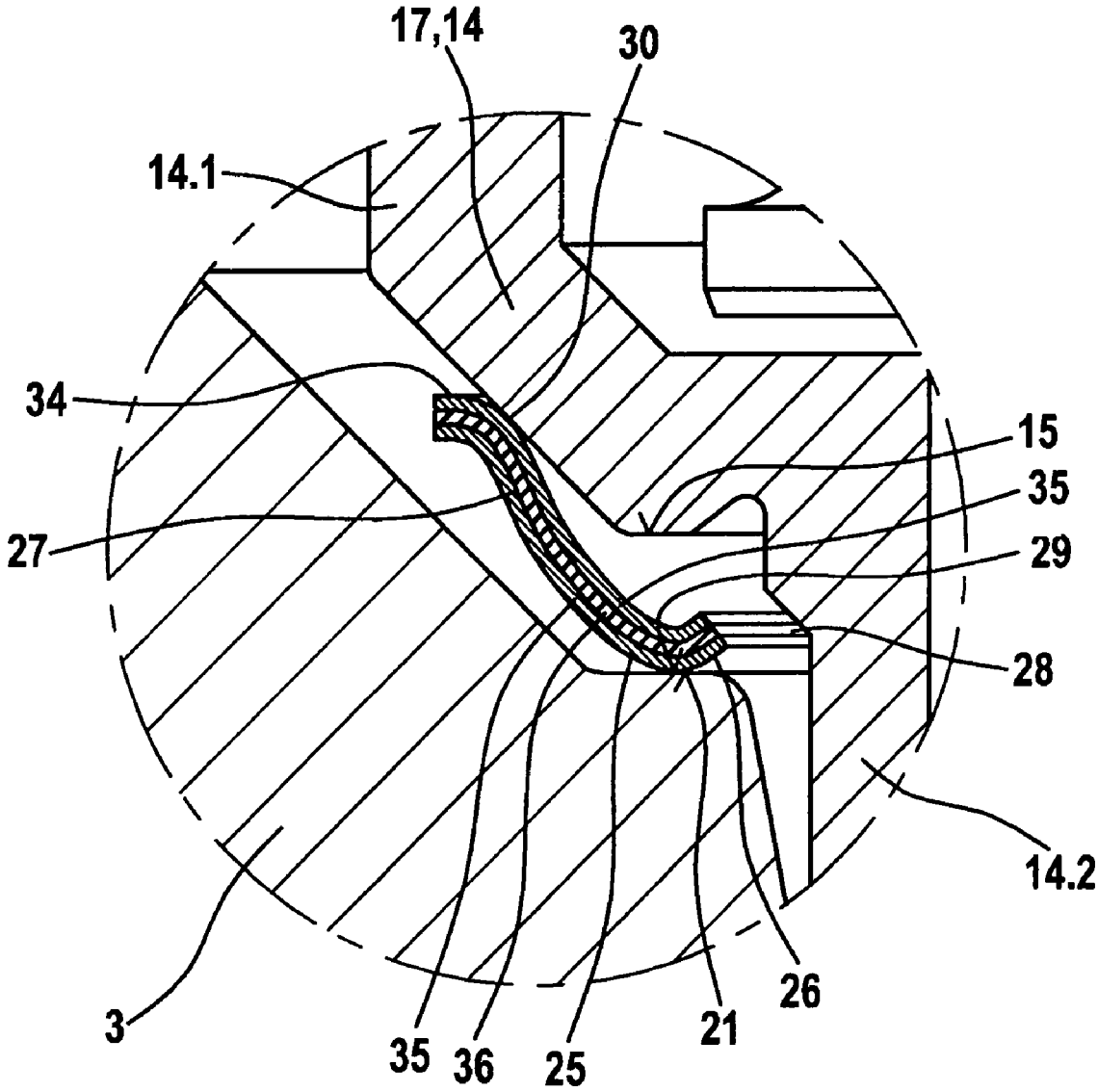
FIG. 4 illustrates aspects of an example embodiment of the present invention.

Several exemplary embodiments of the present invention are depicted in simplified fashion in the drawings and explained further in the description that follows. FIG. 1 shows, in section, a fuel injection valve in a receiving bore of a cylinder head, FIG. 2 illustrates aspects of an exemplary embodiment, FIG. 3 illustrates aspects of an exemplary embodiment, and FIG. 4 illustrates aspects of an exemplary embodiment, in respective details II-IV according to FIG. 1.

FIG. 1 is a simplified depiction of a fuel injection valve in a receiving bore of a cylinder head, having a damping element according to example embodiments of the present invention between the fuel injection valve and the cylinder head.

A fuel injection valve 1 is disposed in a receiving conduit 2 of a cylinder head 3 of an internal combustion engine. Fuel injection valve 1 serves to inject fuel into a combustion chamber 4 of the internal combustion engine and is used, for example, in so-called direct injection. Fuel injection valve 1 has at its inflow end 5, for example, a plug connection to a fuel distribution line 8 that is sealed, for example, by a seal 9 between fuel distribution line 8 and an inflow fitting 10 of fuel injection valve 1. Fuel injection valve 1 also has an electrical connector 11 for electrical contacting of an actuator of fuel injection valve 1, for example, an electromagnetic or a piezoelectric or magnetostrictive actuator, for actuation of fuel injection valve 1.

Fuel injection valve 1 has a valve housing 14 that encompasses an actuator portion 14.1 and a nozzle portion 14.2. The cylindrical nozzle portion 14.2 has a smaller diameter than the cylindrical actuator portion 14.1 of valve housing 14, so that an annular valve shoulder 15 is formed at the transition between portions 14.1, 14.2. Valve shoulder 15 is, for example, conically beveled radially outward toward actuator portion 14.1 with respect to a valve axis 16, so that a conical region 17 is formed on valve housing 14. The actuator, which actuates a valve needle, is disposed in actuator portion 14.1. The valve needle extends from the actuator into nozzle portion 14.2 of valve housing 14. The valve needle has, in conventional fashion, a closure element that coacts with a valve seat disposed on the nozzle portion. In order to open the fuel injection valve, the valve needle having the closure element lifts off from the valve seat so that an outlet gap is formed between the closure element and the valve seat, and fuel that travels via fuel distribution line 8 and inflow fitting 10 into valve housing 14 is injected through the outlet gap into combustion chamber 4.

Receiving conduit 2 is divided into a first conduit portion 2.1 for the reception of actuator portion 14.1 of valve housing 14 and a second conduit portion 2.2 for the reception of nozzle portion 14.2 of valve housing 14. The diameter of second conduit portion 2.2 is smaller than the diameter of first conduit portion 2.1. At the transition from the smaller-diameter second conduit portion 2.2 into the larger-diameter first conduit portion 2.1, an annular first shoulder 2.1 is formed at which, for example, fuel injection valve 1 is mounted. For easier introduction of nozzle portion 14.2 of fuel injection valve 1 into second conduit portion 2.2 of receiving conduit 2, second conduit portion 2.2 is conically expanded at the end facing toward actuator conduit 2.1 A sealing ring 22 provided on nozzle portion 14.2 of fuel injection valve 1 seals a gap between second conduit portion 2.2 and nozzle portion 14.2 of fuel injection valve 1.

Provided between fuel injection valve 1 and receiving conduit 2 is a damping element 25 that abuts, for example, against first shoulder 21 of receiving conduit 2 and braces fuel injection valve 1 in conical region 17.

Damping element 25 serves to reduce the transfer of vibration and solid-borne sound from the fuel injection valve to cylinder head 2 of the internal combustion engine. A fuel injection valve, e.g., one having a piezoelectric actuator, can be excited to vibrate strongly, e.g., in a context of multiple injections per injection cycle, so that effective solid-borne sound decoupling between the fuel injection valve and the cylinder head is necessary in order to prevent troublesome noise, proceeding from the fuel injection valve, from being perceived in a vehicle.

According to example embodiments of the present invention, damping element 25 is arranged in plate-shaped fashion. An arrangement that saves a great deal of installation space is thereby achieved. For example, only 1.5 millimeters are available for damping element 25 in the axial direction between first shoulder 21 of cylinder head 3 and fuel injection valve 1.

Damping element 25 has, according to example embodiments of the present invention, a first portion 26 for bracing or abutment against a shoulder of receiving conduit 2 in cylinder head 3, for example, first shoulder 21, and a second portion 27, angled with respect to first portion 26, for bracing the fuel injection valve. The plate shape of damping element 25 is created by second portion 27 that is angled with respect to first portion 26. First portion 26 is arranged, for example, in circular fashion, and second portion 27 in annular fashion. The two portions 26, 27 are joined integrally to one another. Damping element 25 has a passthrough opening 28 that imparts an annular shape to damping element 25 and through which fuel injection valve 1 can penetrate. Passthrough opening 28 is provided in first portion 26, so that base 26 of plate 25 has an opening.

Damping element 25 is manufactured, e.g., from metal, for example, steel, and/or plastic. Damping element 25 is fabricated, for example, from sheet metal, for example, having a thickness of 1.5 millimeters. The plate shape of damping element 25 is achieved, for example, by a reshaping method, metal-removing shaping, or a primary forming method.

First portion 26 extends, for example, from second portion 27 radially inward with respect to valve axis 16. First portion 26 can, however, also be disposed on second portion 27 radially outward with respect to valve axis 16. The radially inwardly disposed first portion 26 has the advantage, as compared with the radially outwardly disposed first portion 26, that the shoulder of cylinder head 3 against which the damping element abuts is easier to manufacture.

First portion 26 is, for example, arranged in substantially flat or convex fashion, and abuts with a first support 29, for example, against the planar first shoulder 21. The surface area of first support 29 is to be made as small as possible in order to decrease acoustic transmission. First support 29 is, for example, the flat underside, facing toward first shoulder 21, of damping element 25. First support 29 can, however, also be constituted by one or more elevations, disposed on the lower side of damping element 25, that can have any shape and are, for example, rounded in order to achieve good radial displaceability.

Second portion 27 protrudes in collar-shaped fashion from first portion 26 of damping element 25. For example, second portion 27 is arranged at least substantially conically; a convexity outward toward cylinder head 3 can also be provided. Second portion 27 abuts with a second support 30, for example, against conical region 17 of valve housing 14. Damping element 25 is centered with respect to valve axis 16 by conical region 17 of fuel injection valve 1 and by conical second region 27 that coacts with conical region 17. Second support 30 is part of the upper side, facing toward fuel injection valve 1, of damping element 25. One or more elevations are provided, for example, on the upper side of damping element 25, which elevations form second support 30 and are, e.g., rounded. An annular flange 33 is disposed, for example, as second support 30 on the upper side of damping element 25. What results is, for example, a linear contact of fuel injection valve 1 against damping element 25, thus achieving gimbaled mounting.

Forces proceeding from fuel injection valve 1 are transferred via second support 30, collar 27 of damping element 25, and first support 29 to cylinder head 3. There exists between first support 29 and second support 30 not only an axial spacing but also a radial spacing, which represents a lever arm. This lever arm of collar 27 results in an axial elasticity of damping element 25 with respect to valve axis 16, which elasticity brings about a solid-borne sound damping in that the periodic switching pulses of the actuator of fuel injection valve 1 are transferred in greatly attenuated fashion via first shoulder 21 to cylinder head 3. Very small relative motions occur between fuel injection valve 1 and damping element 25 at second support 30, so that additional vibration damping is accomplished by friction. The larger the lever arm is dimensioned, the greater the elasticity of damping element 25.

The transition from first portion 26 to second portion 27 can be sharp-edged or rounded.

Because of the planar arrangement of first shoulder 21, damping element 25 disposed in receiving conduit 2 is displaceable radially with respect to valve axis 16. The radial displaceability of damping element 25 is necessary because, as a result of tolerances, a conduit axis 31 of nozzle portion 2.2 of receiving conduit 2 and an inflow axis 32 of fuel distribution line 8 do not always align.

FIG. 2 shows a damping element according to an example embodiment of the present invention, in a detail II according to FIG. 1.

In the context of the damping element according to FIG. 2, parts that remain the same, or function in the same manner, as compared with the fuel injection valve according to FIG. 1 are labeled with the same reference characters.

The raised flange 33 on an end of second portion 27 facing away from first portion 26 is disposed on the upper side facing toward fuel injection valve 1.

FIG. 3 shows a damping element according to an example embodiment of the present invention, in a detail III according to FIG. 1.

In the context of the damping element according to FIG. 3, parts that remain the same, or function in the same manner, as compared with the fuel injection valve according to FIG. 1 and the exemplary embodiment according to FIG. 2 are labeled with the same reference characters.

The damping element according to FIG. 3 differs from the damping element according to FIG. 2 in that the longitudinal extension of collar 27 is greater. The rigidity of damping element 25 is thereby increased. Flange 33 is disposed not at an end, facing away from first portion 26, of second portion 27, but instead at approximately half the longitudinal extension of collar 27 on the upper side facing toward fuel injection valve 1.

FIG. 4 shows a damping element according to an example embodiment of the present invention, in a detail IV according to FIG. 1.

In the context of the damping element according to FIG. 4, parts that remain the same, or function in the same manner, as compared with the fuel injection valve according to FIG. 1 and the exemplary embodiments according to FIGS. 2 and 3 are labeled with the same reference characters.

The damping element according to FIG. 4 differs from the damping elements according to FIG. 2 and FIG. 3 in that the damping element is manufactured from a composite material made up of two cover panels 35 and an elastic intermediate layer 36 provided between cover panels 35. Cover panels 35 and intermediate layer 36 are in each case joined fixedly to one another. In a context of flexural vibrations of damping element 25, cover panels 35 shift relative to one another with the result that periodic shear deformations occur in elastic intermediate layer 36. The internal friction in elastic intermediate layer 36 causes vibratory energy to be lost as mechanical energy, so that vibration damping, and therefore solid-borne sound damping, is achieved.

First portion 26 of damping element 25 is not planar but instead convex toward first shoulder 21. Second portion 27 is arranged in substantially conical and additionally convex fashion. Adjoining second portion 27 radially outward is, for example, a second shoulder 34. The transition from second portion 27 to second shoulder 34 is, for example, rounded.

The composite material, which is at first planar in its initial shape, is converted into a plate shape, for example, by reshaping.

It is also possible to dispose multiple damping elements 25 according to the exemplary embodiments presented, one above another in layered fashion, in order to achieve even better noise damping.

What is claimed is:

1. A damping element for a fuel injection valve insertable into a receiving conduit of a cylinder head of an internal combustion engine, the damping element arranged between a valve housing of the fuel injection valve and a wall of the receiving conduit of the cylinder head, wherein:

the damping element is arranged in a plate-shaped fashion, the damping element includes a first portion for bracing against a shoulder of the receiving conduit of the cylinder head and a second portion, angled with respect to the first portion, for bracing of the fuel injection valve, and the first portion is configured to form a recess between the fuel injection valve and a side of the first portion facing the fuel injection valve such that the first portion and the fuel injection valve do not make direct contact.

2. The damping element according to claim 1, wherein the first portion extends from the second portion radially inward with respect to a valve axis.

3. The damping element according to claim 1, wherein the first portion is arranged in substantially one of (a) a flat and (b) a convex fashion.

4. The damping element according to claim 1, wherein the second portion is arranged in a collar-shaped fashion.

5. The damping element according to claim 4, wherein the second portion is arranged in substantially at least one of (a) a conical and (b) a convex fashion.

6. The damping element according to claim 1, wherein the damping element includes a passthrough opening penetratable by the fuel injection valve.

7. The damping element according to claim 6, wherein the damping element includes a first portion for bracing against a shoulder of the receiving conduit in the cylinder head and a second portion, angled with respect to the first portion, for bracing of the fuel injection valve, the passthrough opening provided on the first portion.

8. The damping element according to claim 1, wherein the first portion and the second portion have at least one support, one of (a) for bracing against the cylinder head and (b) for bracing of the fuel injection valve, arranged one of (a) in planar fashion and (b) as an elevation.

9. The damping element according to claim 1, wherein the damping element includes two cover panels and an elastic intermediate layer disposed between the cover panels.

10. The damping element according to claim 1, wherein the second portion is configured to form a second recess between the receiving conduit of the cylinder head and a side of the second portion facing the receiving conduit of the cylinder head such that the second portion and the receiving conduit of the cylinder head do not make direct contact.

11. The damping element according to claim 8, wherein the at least one support of the second portion includes at least one elevation on a side of the second portion facing the fuel injection valve.

12. The damping element according to claim 11, wherein the at least one elevation on the side of the second portion facing the fuel injection valve is at least one of (a) rounded and (b) arranged as an annular flange.

13. The damping element according to claim 11, wherein the at least one elevation on the side of the second portion facing the fuel injection valve is arranged at least one of (a) on an end of the second portion facing away from the first portion and (b) approximately halfway along a length of the second portion facing away from the first portion.

14. A damping element for a fuel injection valve insertable into a receiving conduit of a cylinder head of an internal combustion engine, the damping element arranged between a valve housing of the fuel injection valve and a wall of the receiving conduit of the cylinder head, wherein:

the damping element includes a first portion for bracing against a shoulder of the receiving conduit of the cylinder head and a second portion for bracing of the fuel injection valve;

the damping element is arranged in a plate-shaped fashion;

the first portion is angled with respect to the second portion and extends from the second portion radially inward with respect to a valve axis; and the second portion is arranged conically and includes at least one elevation adapted to form a support for the fuel injection valve, on an upper side facing the fuel injection valve, the at least one elevation interacting with a conical region of the valve housing, thereby forming a cardanic mounting between the conical region of the valve housing and the damping element.

15. The damping element according to claim 14, wherein the first portion is arranged in substantially one of (a) a flat and (b) a convex fashion.

16. The damping element according to claim 14, wherein the second portion is arranged in a collar-shaped fashion.

17. The damping element according to claim 14, wherein the damping element includes a passthrough opening penetratable by the fuel injection valve.

18. The damping element according to claim 17, wherein the passthrough opening is arranged on the first portion.

* * * * *